US011033127B2

(12) United States Patent
Floyd-Vester et al.

(10) Patent No.: US 11,033,127 B2
(45) **Date of Patent: *Jun. 15, 2021**

(54) PICNIC SIZE CARRY CONTAINER THAT CONVERTS INTO A PROTECTIVE MAT

(71) Applicant: VECHER HOLDINGS INTERNATIONAL INC., Vancouver (CA)

(72) Inventors: Rita Floyd-Vester, Coral Springs, FL (US); Csaba Vester, Coral Springs, FL (US)

(73) Assignee: VECHER HOLDINGS INTERNATIONAL, INC., Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/508,445

(22) Filed: Jul. 11, 2019

(65) Prior Publication Data

US 2020/0077817 A1 Mar. 12, 2020

Related U.S. Application Data

(63) Continuation of application No. 14/490,163, filed on Sep. 18, 2014, now Pat. No. 10,349,763, which is a (Continued)

(51) Int. Cl.
*A47G 9/06* (2006.01)
*A45C 9/00* (2006.01)

(Continued)

(52) U.S. Cl.
CPC ..... *A47G 9/062* (2013.01); *A45C 9/00* (2013.01); *A45C 11/20* (2013.01); *A45C 13/103* (2013.01);

(Continued)

(58) Field of Classification Search
CPC ... A45C 11/20; A45C 7/00; A45C 2007/0004; A45C 13/103; A45C 7/0036;

(Continued)

(56) References Cited

U.S. PATENT DOCUMENTS 3,073,367 A * 1/1963 Samara ..... A45C 9/00 383/97
6,502,595 B2 * 1/2003 Louie ..... A63H 33/008 135/125
2003/0190096 A1 * 10/2003 Miodragovic ..... A45C 9/00 383/4

* cited by examiner

*Primary Examiner* — Jes F Pascua
*Assistant Examiner* — Matthew T Theis
(74) *Attorney, Agent, or Firm* — McAndrews, Held & Malloy, Ltd.

(57) ABSTRACT

A carry container is interchangeable between a closed position and an open position, wherein the container converts into a protective mat, such as a placemat, and becomes a barrier against germs. In one embodiment, the carry container includes an outer shell including a bottom panel and four side panels extending from the bottom panel and being configured to releasably attach to each of the two neighboring side panels using a fastener to form a container for carrying one or more items, such as food items. An inner lining formed by a generally square sheet is attached to an inner facing side of the outer shell and defines the protective mat when the outer shell is in an open position and flat on a surface. The container can be easily converted between the closed position (lunch box) and fully open position (protective mat). A larger version for the container is also described with a portion of the inner liner folded in the closed position.

20 Claims, 16 Drawing Sheets

Related U.S. Application Data continuation-in-part of application No. 14/256,980, filed on Apr. 20, 2014, now Pat. No. 10,863,808, which is a continuation-in-part of application No. 13/904,708, filed on May 29, 2013, now abandoned.

(60) Provisional application No. 61/652,418, filed on May 29, 2012.

(51) Int. Cl.

| | |
|---|---|
| *A45C 11/20* | (2006.01) |
| *A45F 4/06* | (2006.01) |
| *A45C 13/10* | (2006.01) |
| *A45C 7/00* | (2006.01) |

(52) U.S. Cl.

CPC ..... *A45C 2007/0004* (2013.01); *A45F 4/06* (2013.01)

(58) Field of Classification Search

CPC ..... A45C 7/0054; A45C 2007/0009; A45C 2007/0013; A47G 9/062; A47D 15/003; A45F 4/06

USPC ..... 383/4, 10, 120; 206/546; 5/417

See application file for complete search history.

PICNIC SIZE CARRY CONTAINER THAT CONVERTS INTO A PROTECTIVE MAT

This application is a continuation of U.S. application Ser. No. 14/490,163, filed Sep. 18, 2014, which is a continuation-in-part of U.S. application Ser. No. 14/256,980, filed Apr. 20, 2014, which is a continuation-in-part of U.S. application Ser. No. 13/904,708, filed May 29, 2013 which claims the benefit of and priority to U.S. Provisional Patent Application Ser. No. 61/652,418, filed May 29, 2012. All applications are incorporated by reference in their entirety.

FIELD OF THE INVENTION

The disclosed embodiments relate to food carrying containers and, more particularly, to a carry container that converts into a placemat for forming a barrier between the surface upon which the container is resting and the user while eating.

BACKGROUND

Studies have shown that the most prevalent area for germs in a school setting is the cafeteria table. Some bacteria are capable of causing infections and tend to collect on frequently touched surfaces, particularly in areas where there is a lot of hand-to-mouth contact like the cafeteria table. When children touch the contaminated surface, the germs are transmitted to their hands, and if they subsequently touch their eyes, nose or lips, it is likely that they have infected themselves. The best way to avoid the spreading of germs is to never touch infected surfaces.

Lunch boxes have long been known and widely used by children all over the world. The majority of lunch boxes used today are not washable and, therefore, cannot be properly sanitized. The combination of the unclean lunch boxes and germ-infested cafeteria tables provides an ideal scenario for spreading germs.

Therefore, there is a particular need to overcome the problems discussed above by reducing the amount of germs a child comes into contact with while having a meal away from home, such as, but not limited to, having lunch at a school cafeteria table. The disclosed embodiments are directed to the above-noted problems. However, the disclosed embodiment is neither limited to use by children, nor is limited to use as a placemat in a school cafeteria.

SUMMARY

A first disclosed embodiment is directed to a carry container that is interchangeable between a closed position and an open position, wherein the container (closed position) opens into a protective mat or surface (open position), such as, but not limited to, a placemat, and becomes a barrier against germs. In one embodiment, the container includes an outer shell including a bottom panel and four side panels extending from the bottom panel and being configured to releasably attach to each of the two neighboring side panels using a fastener. The container can be easily converted between the closed position (lunch box, container, etc.) and open position (placemat, protective surface, etc.).

Thus, the disclosed embodiment provides a container that converts into a protective mat for limiting exposure of the user to germs. The container/protective mat can be preferably machine washable. In one preferred use of the disclosed embodiment, the washable container converts into a protective mat is easily converted between a closed position for carrying or storing food items and an open position for eating the food items, as well as other food items that may be in the user's possession.

In a second embodiment a larger dimension for the carry container is provided. One non-limiting use for the larger version is a replacement for a picnic basket. With the larger dimensions as compared to the first embodiment, a plurality of users can use the embodiment for their eating surface. Alternatively, the larger surface can be used as the location to place the various picnic items. The various uses for the larger version are many and not intended to be limited to any specific use or uses. In order to accomondate the larger size, portions of the protective mat can be configured to fold and releasably secure to a central portion, prior to zipping up the side panels to convert the protective mat into a carrying container.

BRIEF DESCRIPTION OF THE DRAWINGS

For a fuller understanding of the nature of the disclosed embodiments, reference should be made to the following detailed description taken in conjunction with the accompanying drawings in which.

Like reference numerals refer to like parts throughout the several views of the drawings.

DETAILED DESCRIPTION OF PREFERRED EMBODIMENT

Referring to the several views of the drawings (FIG. 1 through FIG. 2), in a first embodiment, the washable carriable container that converts into a protective mat is shown and is generally indicated at reference number 10.

Figure 1:
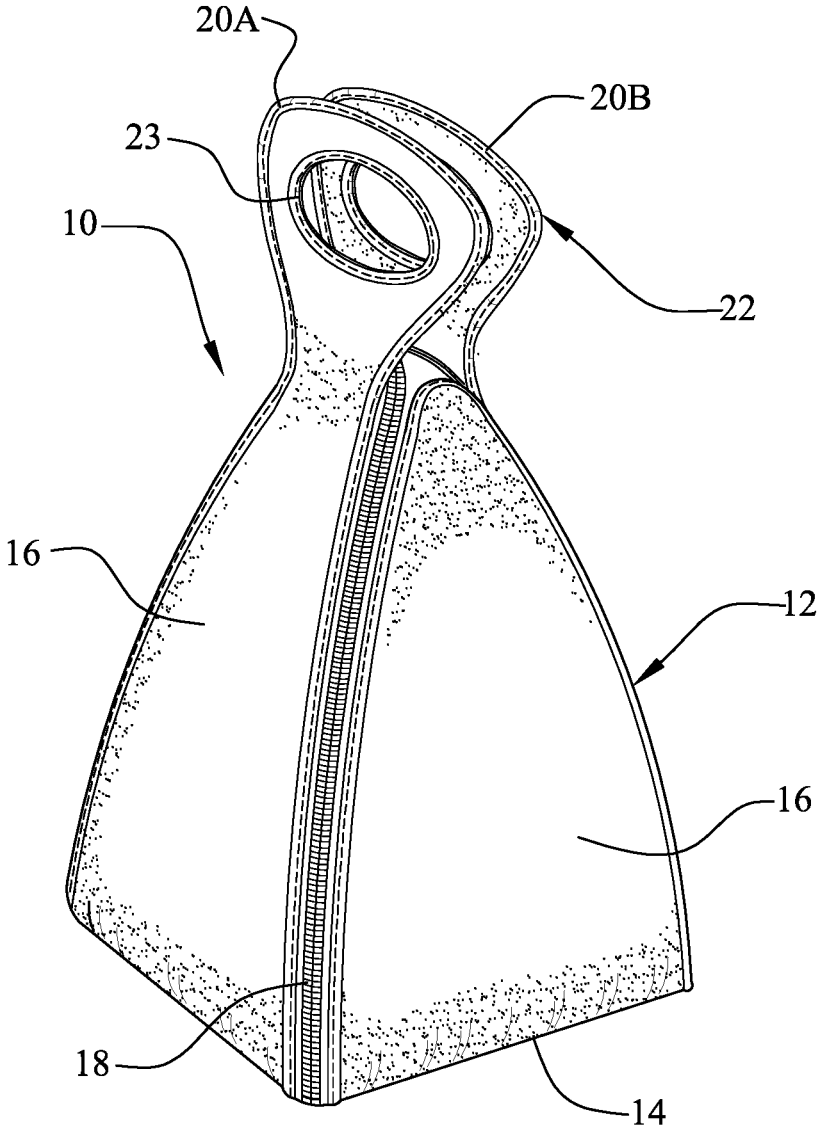
FIG. 1 is a perspective view illustrating the food carrying container in a closed postion, which is capable of converting into a protective mat in an opened position.
Figure 2:
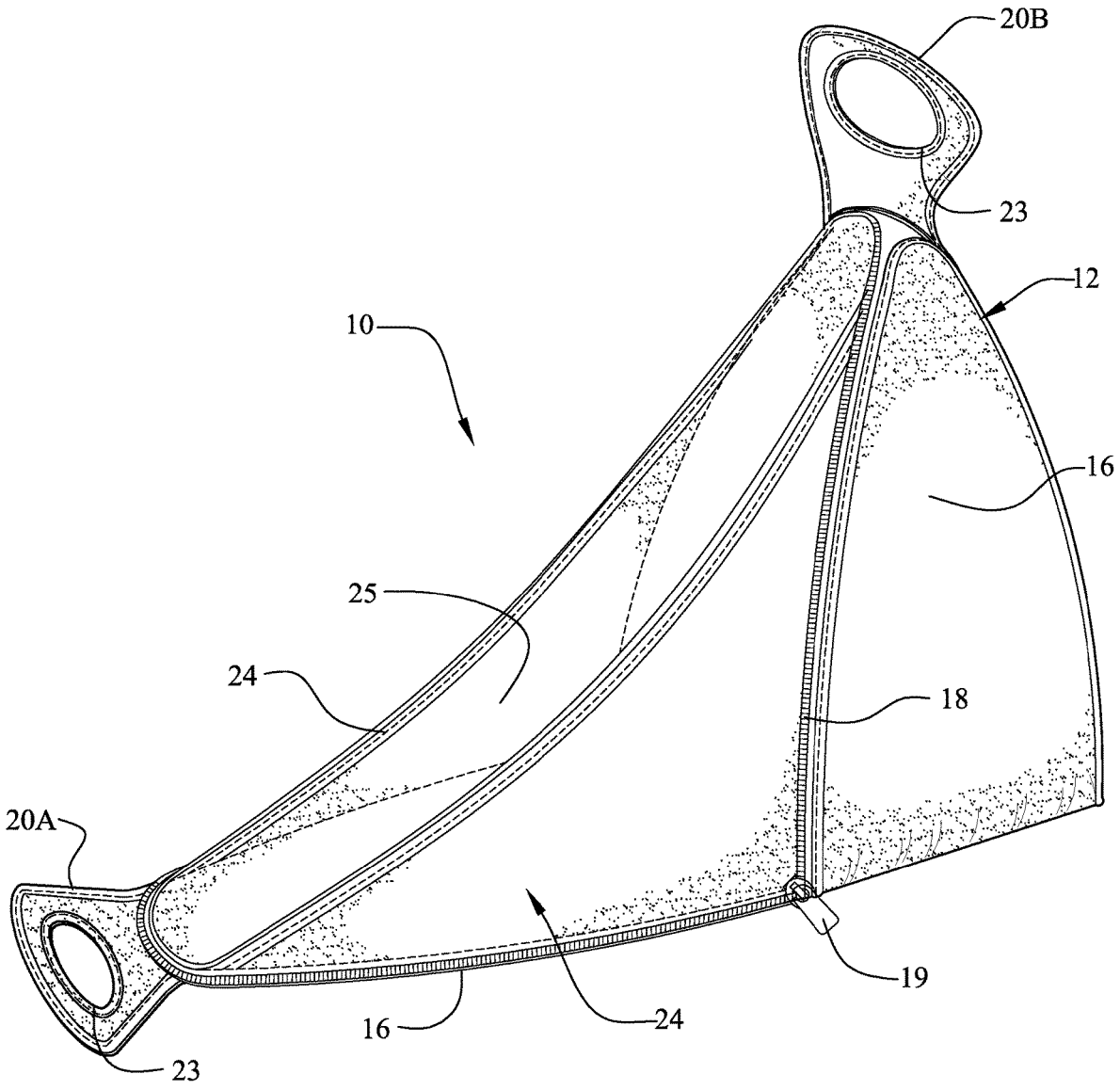
FIG. 2 is a perspective view illustrating the food carrying container of FIG. 1 in a partially opened position, wherein one side panel is open, thus providing access to any contents (not shown) being stored within the container.

Referring initially to FIGS. 1 and 2, the convertible and washable container 10 includes a shell or outer shell 12 (outer in the closed position/configuration) including an integrally formed bottom panel 14 and side panels 16. Bottom panel 14 and side panels 16 can be monolithically formed as a one-piece member, can be constructed from a single piece of material, can be separate pieces of materials that can be preferably permanently secured together, such as, but not limited to, by stitching, sewing, welding, etc.

A plurality of fasteners 18 on each of the side panels 16 are configured to secure the panels 16 together. In a preferred embodiment, the fasteners 18 are zipper fasteners and include zipper pull tabs 19 for manually fastening and unfastening the side panels 16, as shown in the drawings. Other embodiments of the fasteners 16 include hook and loop fasteners, clips, or any other suitable closure mechanisms.

The washable food carrying container 10 is interchangeable between a closed position and an open position. The closed position, wherein the fasteners 18 are securing the side panels 16 together, represents a container having an interior cavity suitable for storing food items and other items. In a preferred embodiment, the side panels 16 and fasteners 18 are configured such that the container 10 is substantially dome or pyramid-shaped when in the closed position. In one embodiment, handle members 20A and 20B are included on opposite facing side panels 16 for forming a handle 22 when the container 10 is in the closed position. Each handle member 20A and 20B may include a handle opening 23 sized for receiving a portion of a user's hand. Alternatively, the handle 22 and opening 23 may be formed as extensions of opposing side panels 16 (FIG. 5) or can be secured to opposing side panels 16 (FIG. 3) such as, but not limited to, by stitching, discussed in more detail in the next paragraph.

Figure 3:
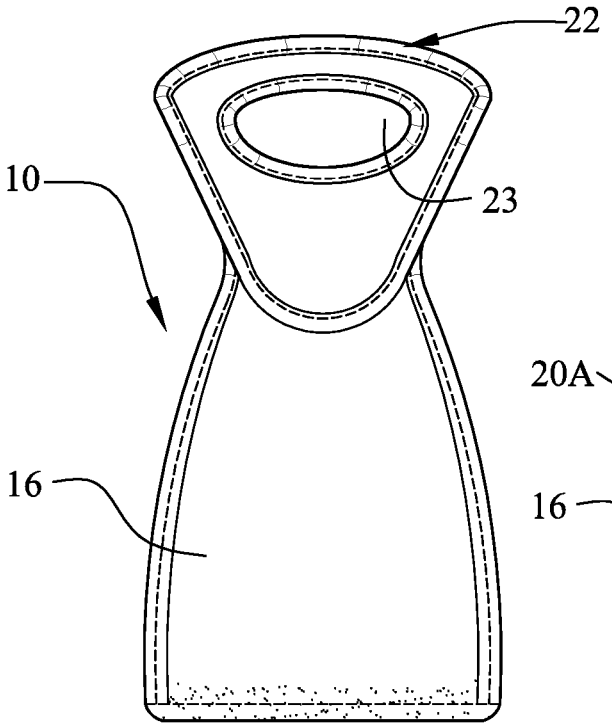
FIG. 3 is a side view illustrating the food carrying container of FIG. 1 in the closed position.
Figure 4:
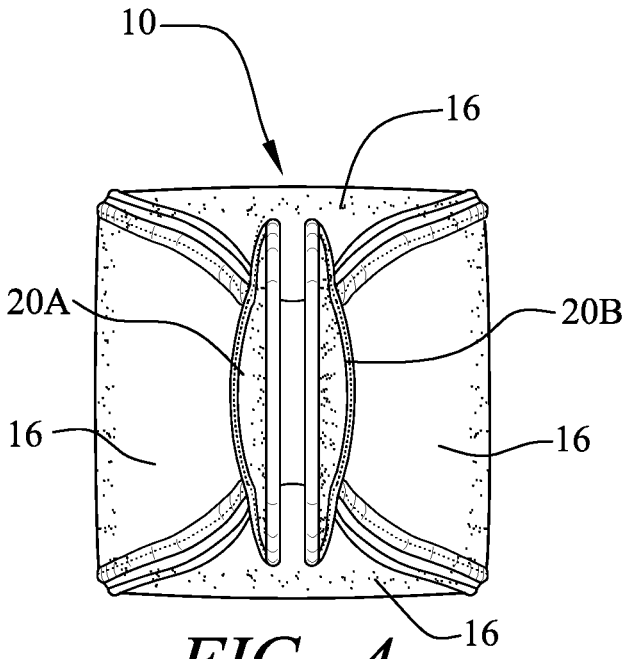
FIG. 4 is a top view illustrating the food carrying container of FIG. 1 in the closed position.
Figure 5:
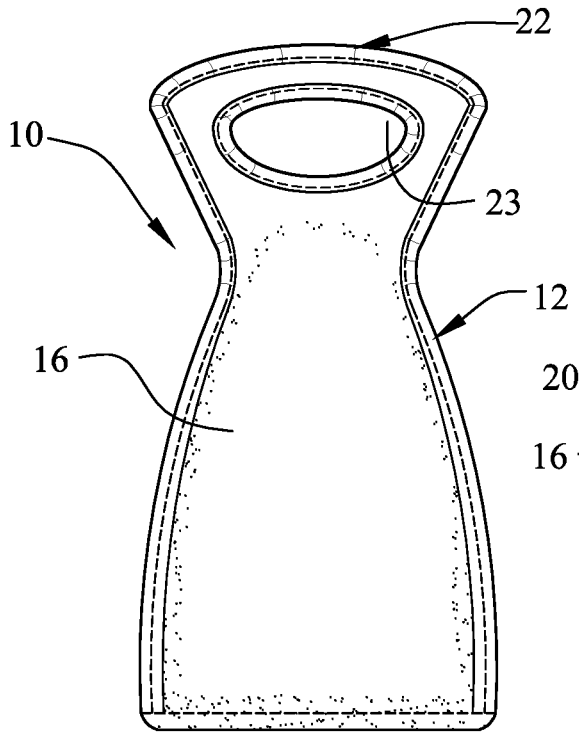
FIG. 5 is a front side view illustrating the food carrying container of FIG. 1 in the closed position.
Figure 6:
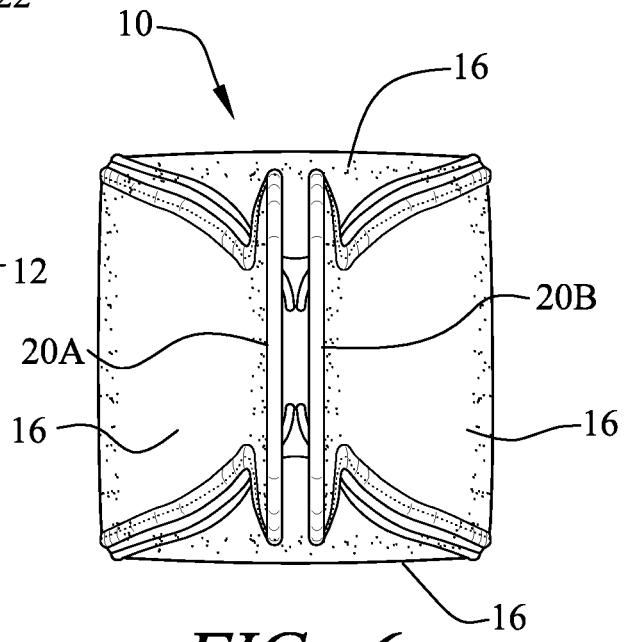
FIG. 6 is a top view illustrating the food carrying container of FIG. 1 in the closed position.

Referring to FIGS. 3-6, two different embodiments of the food container 10 are shown. FIGS. 3 and 4 illustrate a first embodiment of the handle 22, wherein handle members 20A and 20B are sewn onto opposite facing side panels 16. FIGS. 5 and 6 illustrate an alternative embodiment of the handle 22, wherein handle members 20A and 20B are formed as part of the outer shell 12 at opposite facing side panels 16.

Figure 7:
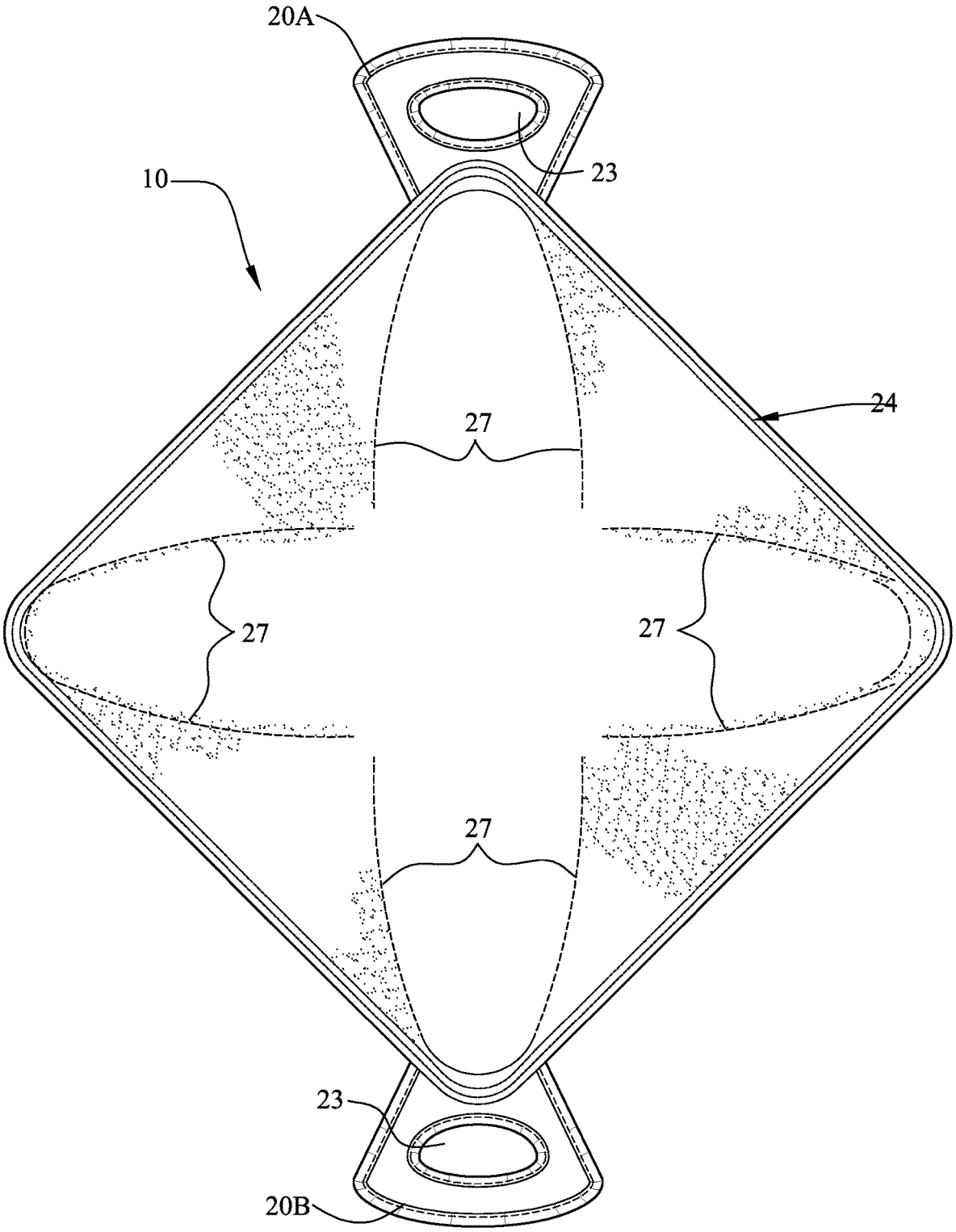
FIG. 7 is a top view illustrating the food carrying container that converts into a protective mat according to one embodiment in the open position.
Figure 8:
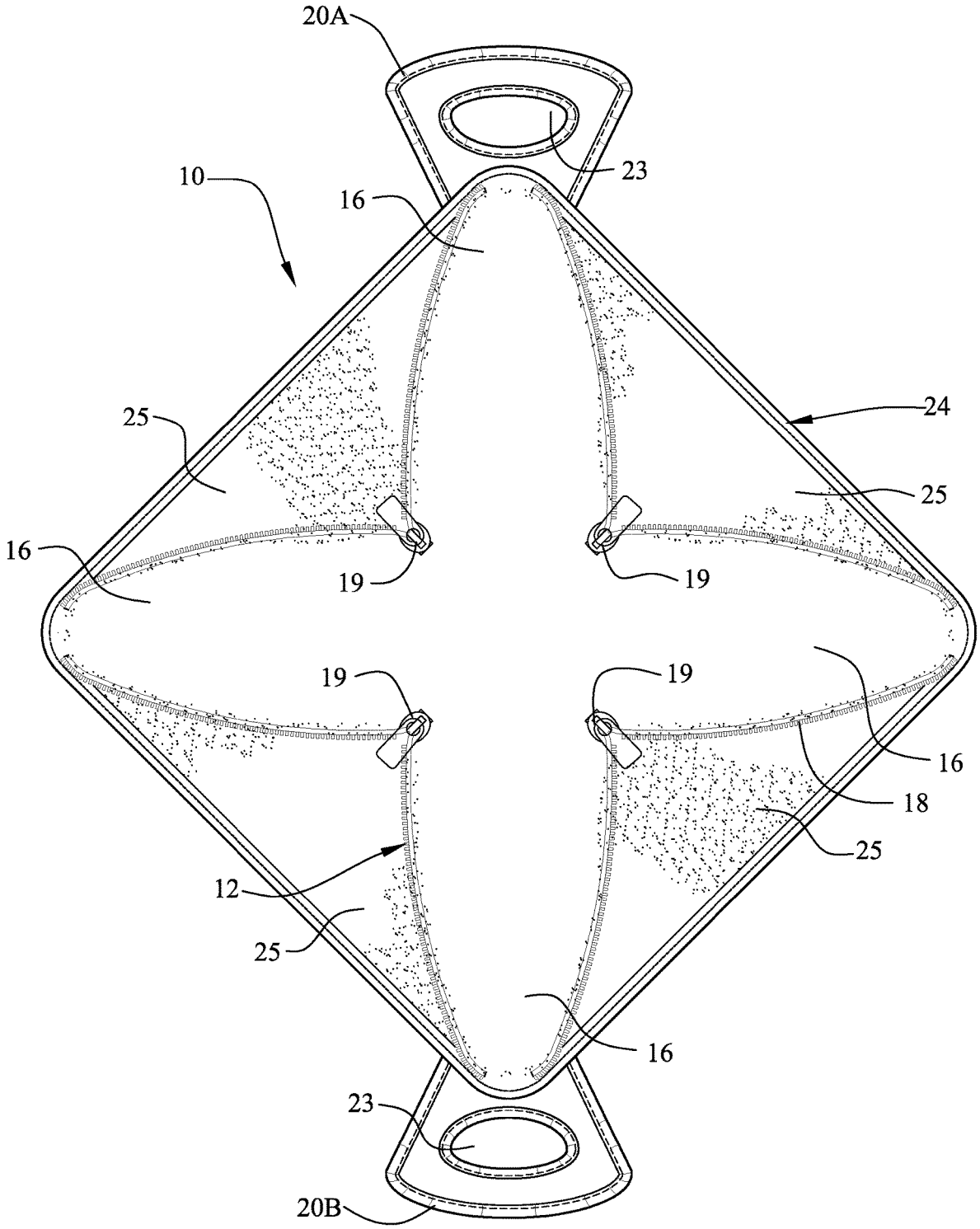
FIG. 8 is a bottom view illustrating the food carrying container that converts into a protective mat of FIG. 7 in the open position.
Figure 9:
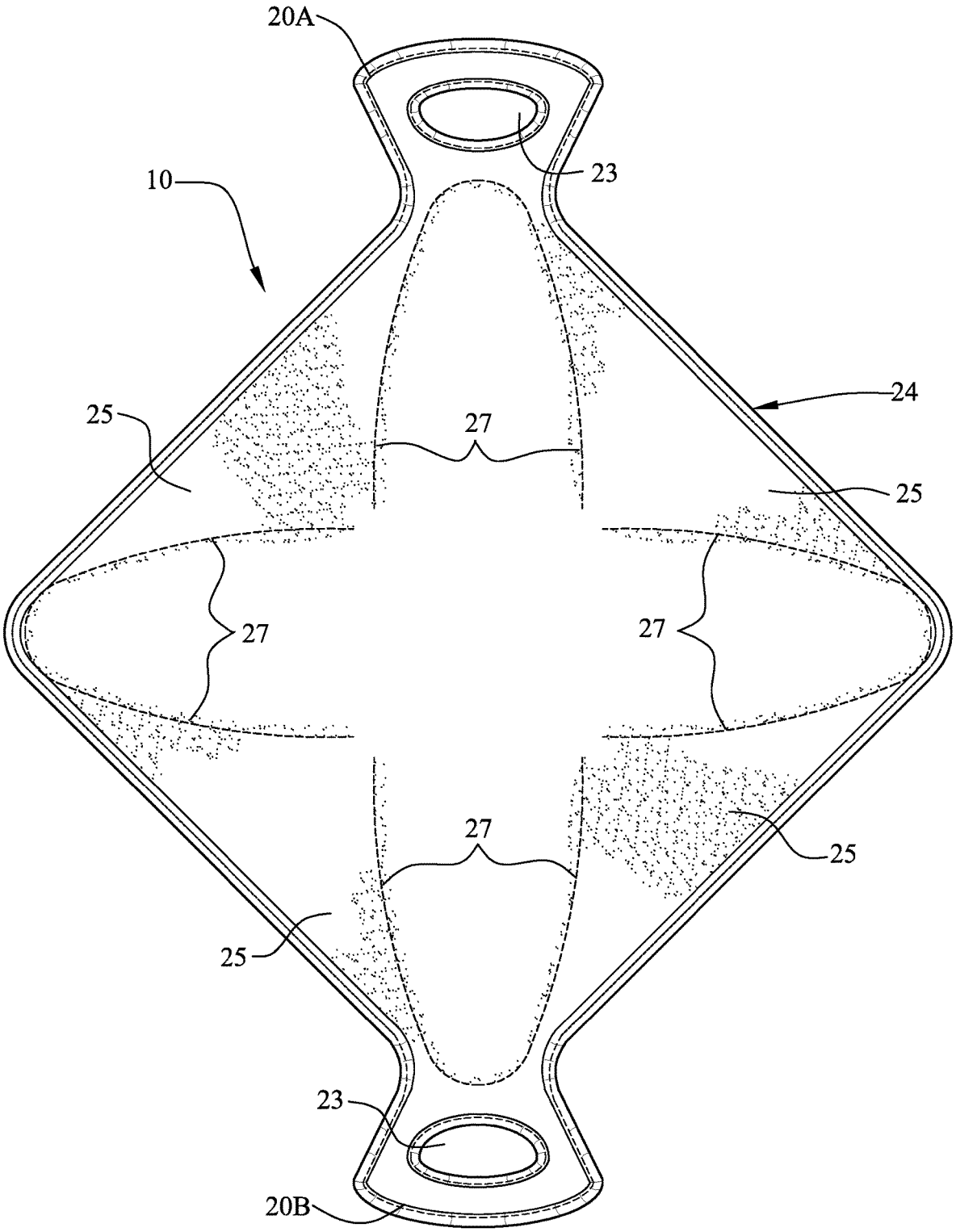
FIG. 9 is a top view illustrating the food carrying container that converts into a protective mat according to another embodiment in the open position.

Referring to FIGS. 7-10, the container 10 is shown in the open position, wherein the fasteners 18 are undone and the side panels 16 are separated from each other. The open position represents a protective mat configuration for forming a barrier between the surface upon which the container 10 is resting and the user. An inner lining 24 serves as the protective mat, such as a placemat, when the container 10 is in the open position. The inner lining 24 is attached to the inner facing side of the outer shell 12. When inner lining 24 is secured to outer shell, portions of of inner lining 24 form webbing that covers over the space defined between adjacent side panels 16 in the open configuration. Inner lining 24 forms the continuous eating surface by itself. Side panels 16 play no role in forming the continuous eating surface as they are all disposed underneath inner lining 24 in the open position/configuration. In one embodiment, the inner lining 24 is attached to the inner facing side of the outer shell by stitching 27, as shown in FIGS. 7 and 9. Other suitable means of attaching the inner lining to the outer shell may be used as well.

Figure 10:
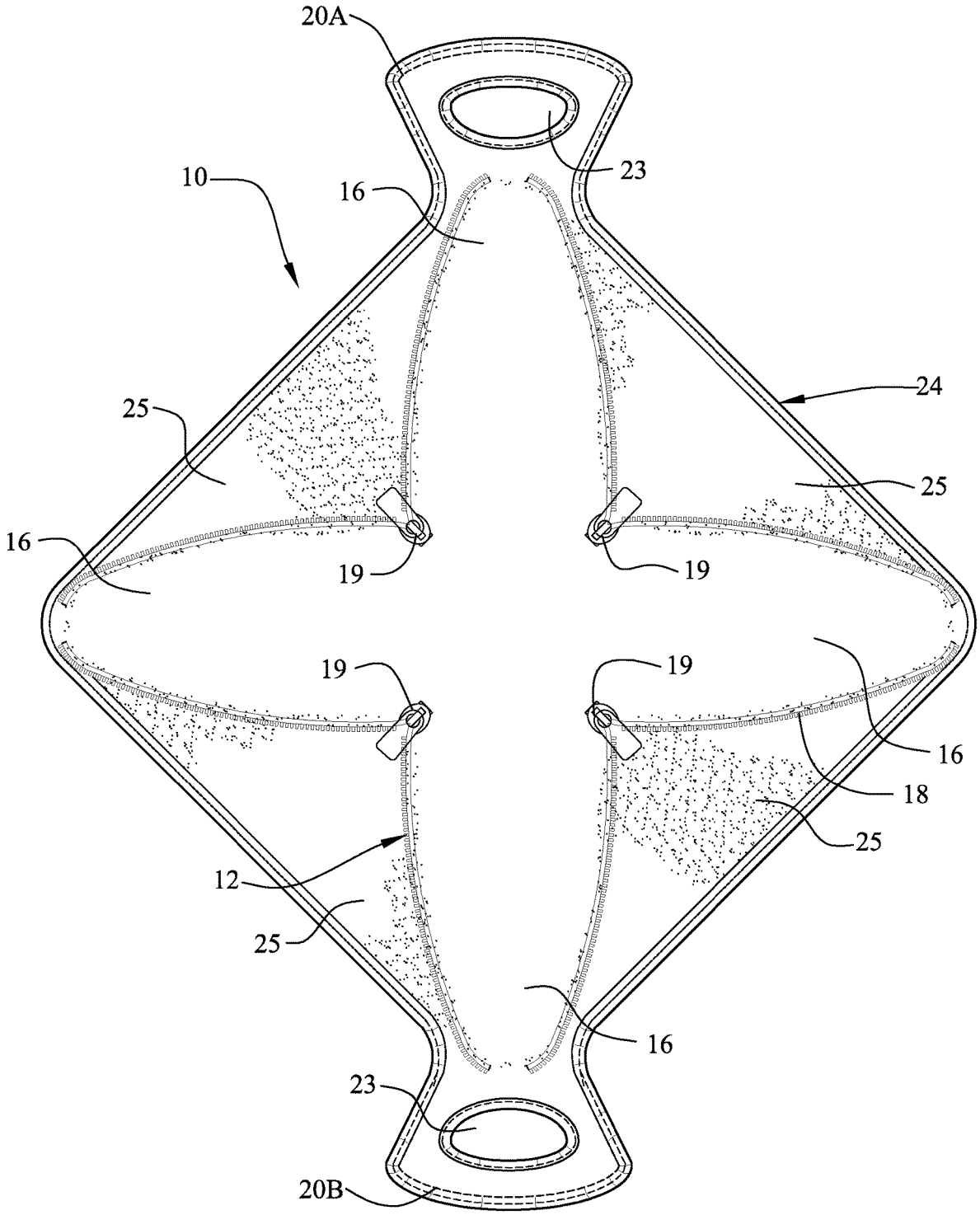
FIG. 10 is a bottom view illustrating the food carrying container that converts into a protective mat of FIG. 9 in the open position.
Figure 11:
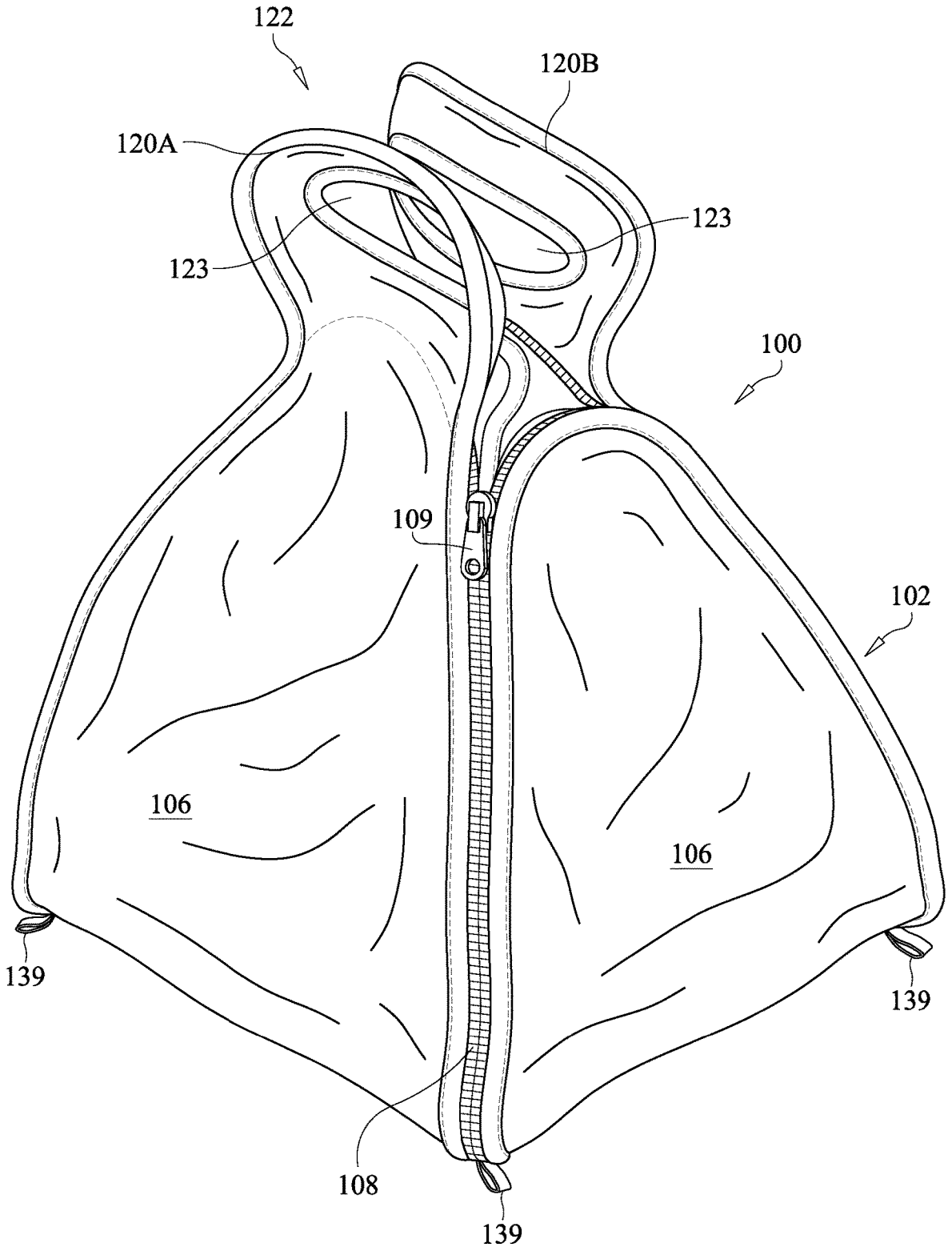
FIG. 11 is a top perspective view illustrating a second embodiment for the food carrying container in a closed position, which is capable of converting into a protective mat in an opened position, with the second embodiment preferably larger in size as compared to the first embodiment shown in FIG. 1 to FIG. 10.
Figure 12:
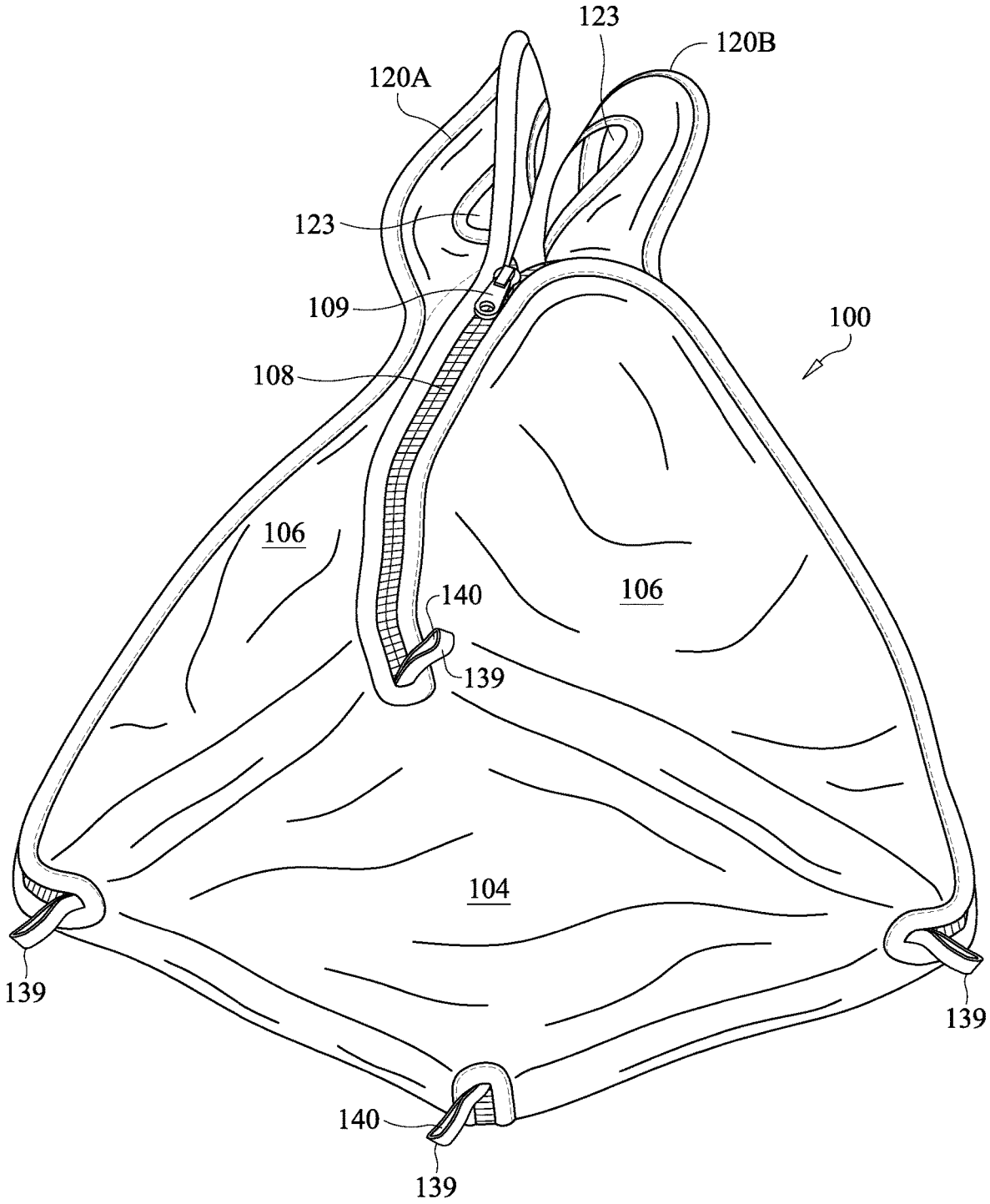
FIG. 12 is a bottom perspective view illustrating the food carrying container of FIG. 11 in the closed position.
Figure 13:
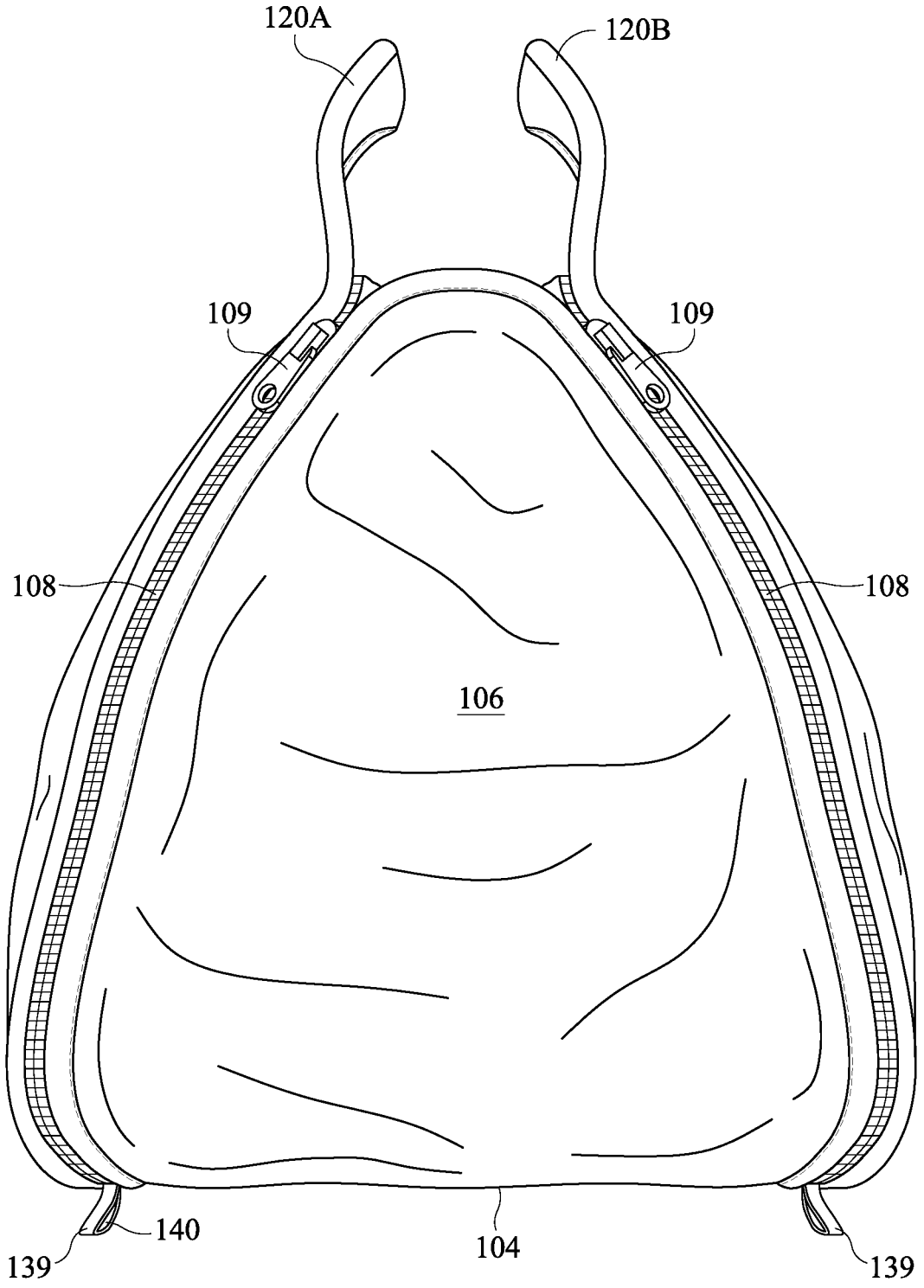
FIG. 13 is a side view illustrating the food carrying container of FIG. 11 in the closed position.
Figure 14:
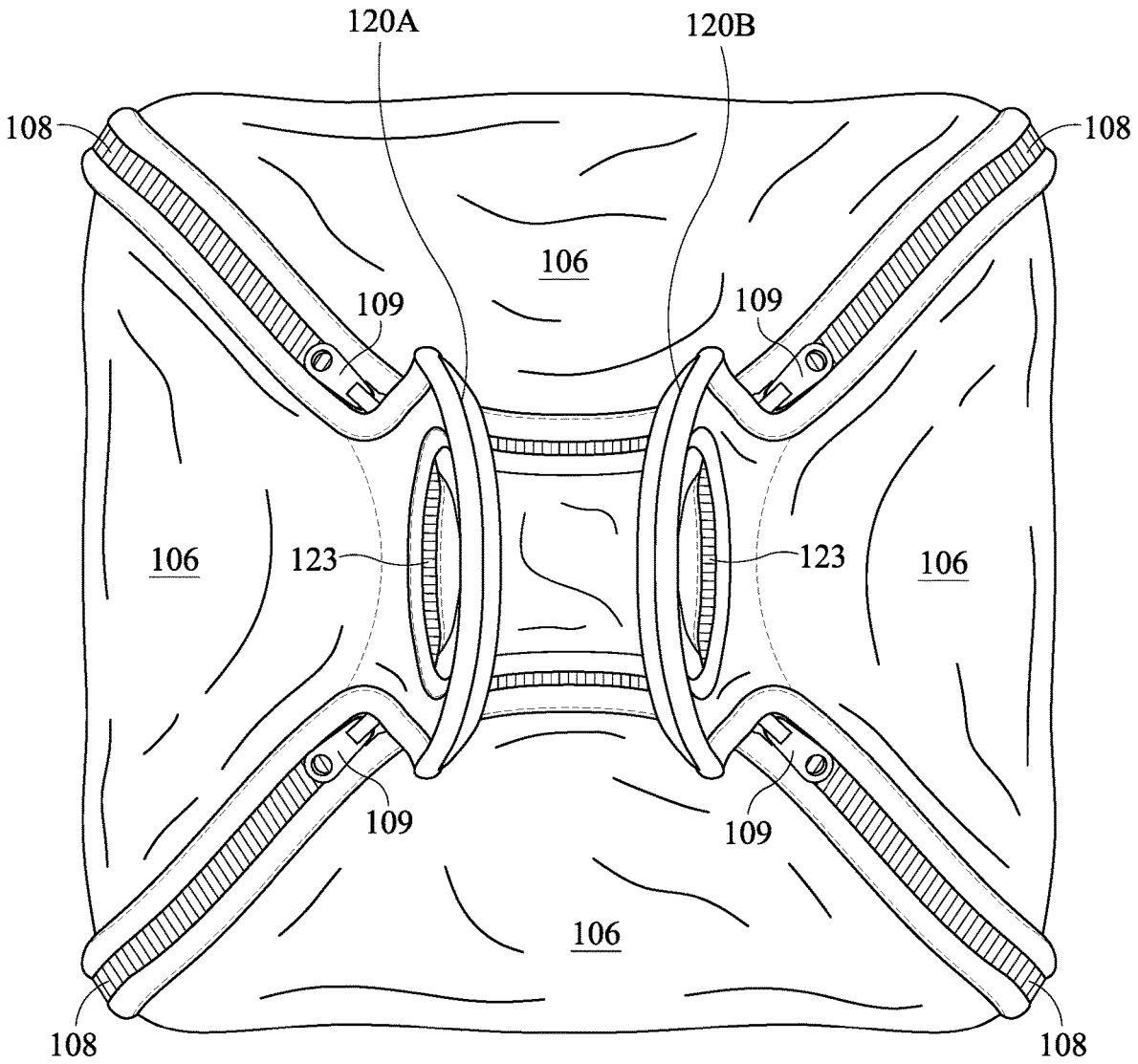
FIG. 14 is a top view illustrating the food carrying container of FIG. 11 in the closed position.
Figure 15:
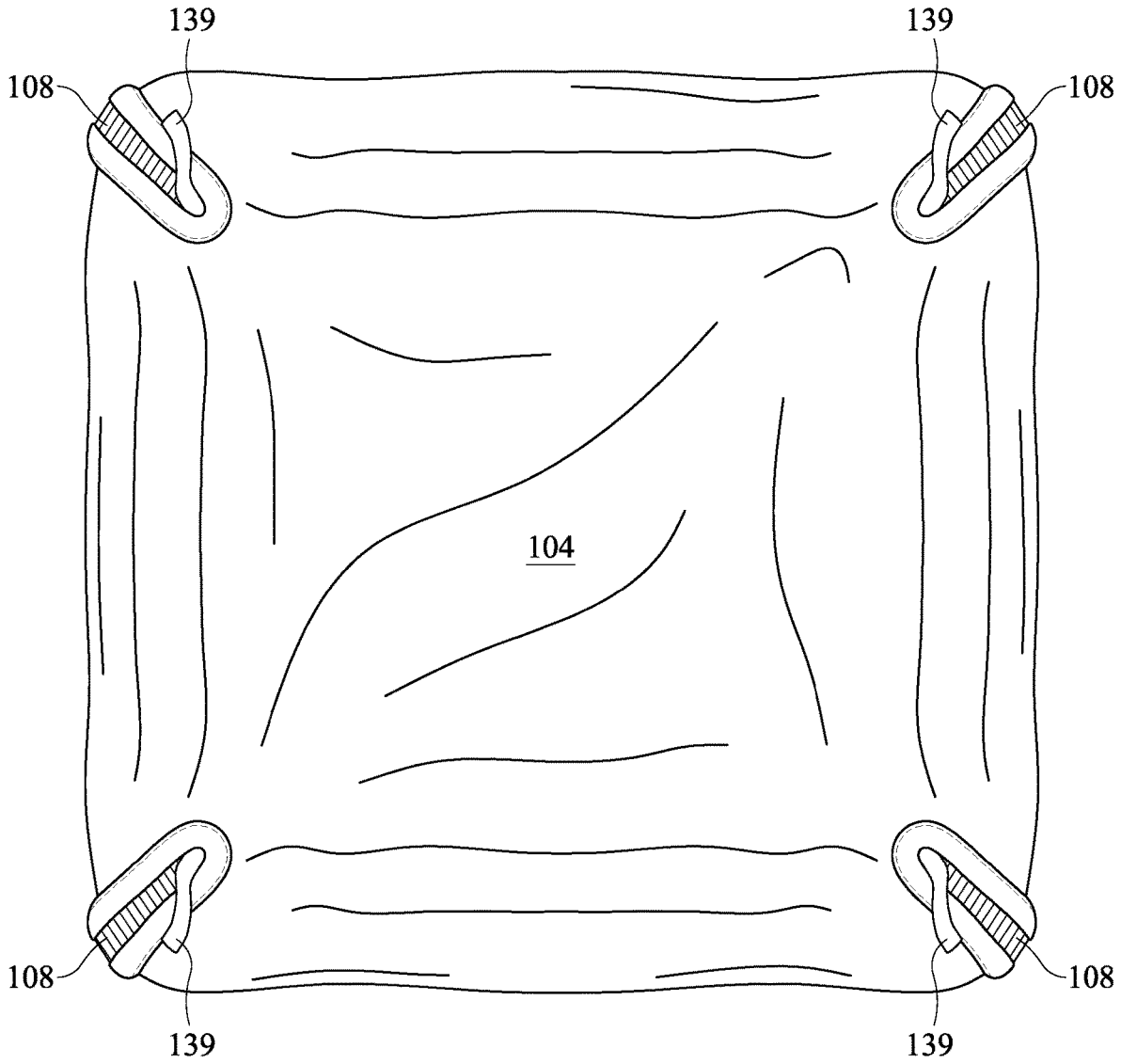
FIG. 15 is a bottom view illustrating the food carrying container of FIG. 11 in the closed position.

The open position, with inner lining 24 providing a continuous eating surface, decreases the likelihood that a user's hands or food items will come into contact with the table surface, thereby reducing the spread of bacteria, viruses and fungi. FIGS. 7 and 8 illustrate the embodiment of the container 10 shown in FIGS. 3 and 4, wherein the handle members 20A and 20B are sewn onto opposite facing side panels 16. FIGS. 9 and 10 illustrate the embodiment of the container 10 shown in FIGS. 5 and 6, wherein the handle members 20A and 20B are formed as part of the outer shell 12 at opposite facing side panels 16.

In order to store foods items in the container 10, it is preferable for the container 10 to be partially opened, such that the fasteners 18 are partially separated to allow the upper portions of the side panels 16 to be separated for easy loading of the container 10. Alternatively, the container 10 could be loaded in the open position (i.e. protective mat configuration) and then fastened or, alternatively, with one or two side panels 16 in the open position. As a further alternative, some, but not all, of fasteners 18 can be undone to provide access to internal area of container 10 (See FIG. 2).

In a preferred embodiment, the outer shell 12, inner lining 24 and fasteners 18 can each be made from a machine washable material. In one embodiment, the outer shell 12 can preferably be made from a heat resistant material, such as neoprene fabric. The outer shell 12 may be made from one layer of material. Other embodiments of the outer shell 12 include multiple layers of different materials having varying thicknesses. For example, the outer shell 12 can be made from a heat resistant material and inner lining 24 (i.e. continuous eating surface) of the container 10 can be made from a washable nylon or neoprene fabric. The different layers of materials may be attached together by conventional methods, such as, but not limited to, one or more of the following: adhesives, sewing, stitching, welding, glues, and tapes.

A tab (preferably a fabric tab) can be disposed at the base of each zipper assembly (i.e. at or near the bottom corner in the closed figuration), which can be grabbed by the user and makes moving the associated zipper up and down easier. In one non-limiting embodiment, the tab can be in the form of loop secured at or near the bottom corner in the closed figuration. Additionally, each zipper assembly can be provided with an grab extension (i.e. preferably made from rubber) that is secured to the normal grabbing portion of the zipper to make the grabbing area larger and thus, easier to hold onto when moving the zipper up and down. In one non-limiting embodiment, the grab extension can be substantially rectangularly in shape and can have its outer end somewhat dome shaped.

FIG. 11 through FIG. 19 illustrate a second embodiment for a washable carriable container that converts into a protective mat, which is shown and generally indicated at reference number 100.

Referring initially to FIGS. 11 through 15, the convertible and washable container 100 includes a shell or outer shell 102 (outer in the closed position/configuration) including an integrally formed bottom panel 104 and side panels 106. Bottom panel 104 and side panels 106 can be monolithically formed as a one-piece member, can be constructed from a single piece of material, can be separate pieces of materials that can be preferably permanently secured together, such as, but not limited to, by stitching, sewing, welding, etc.

A plurality of fasteners 108 on each of the side panels 106 are configured to releasably secure adjacent panels 106 together. In a preferred embodiment, the fasteners 108 are zipper fasteners and include zipper pull tabs 109 for manually fastening and unfastening adjacent side panels 106, as shown in the drawings. Other embodiments of the fasteners 108 can include, without limitation, hook and loop fasteners, clips, or any other suitable closure mechanisms.

Figure 16:
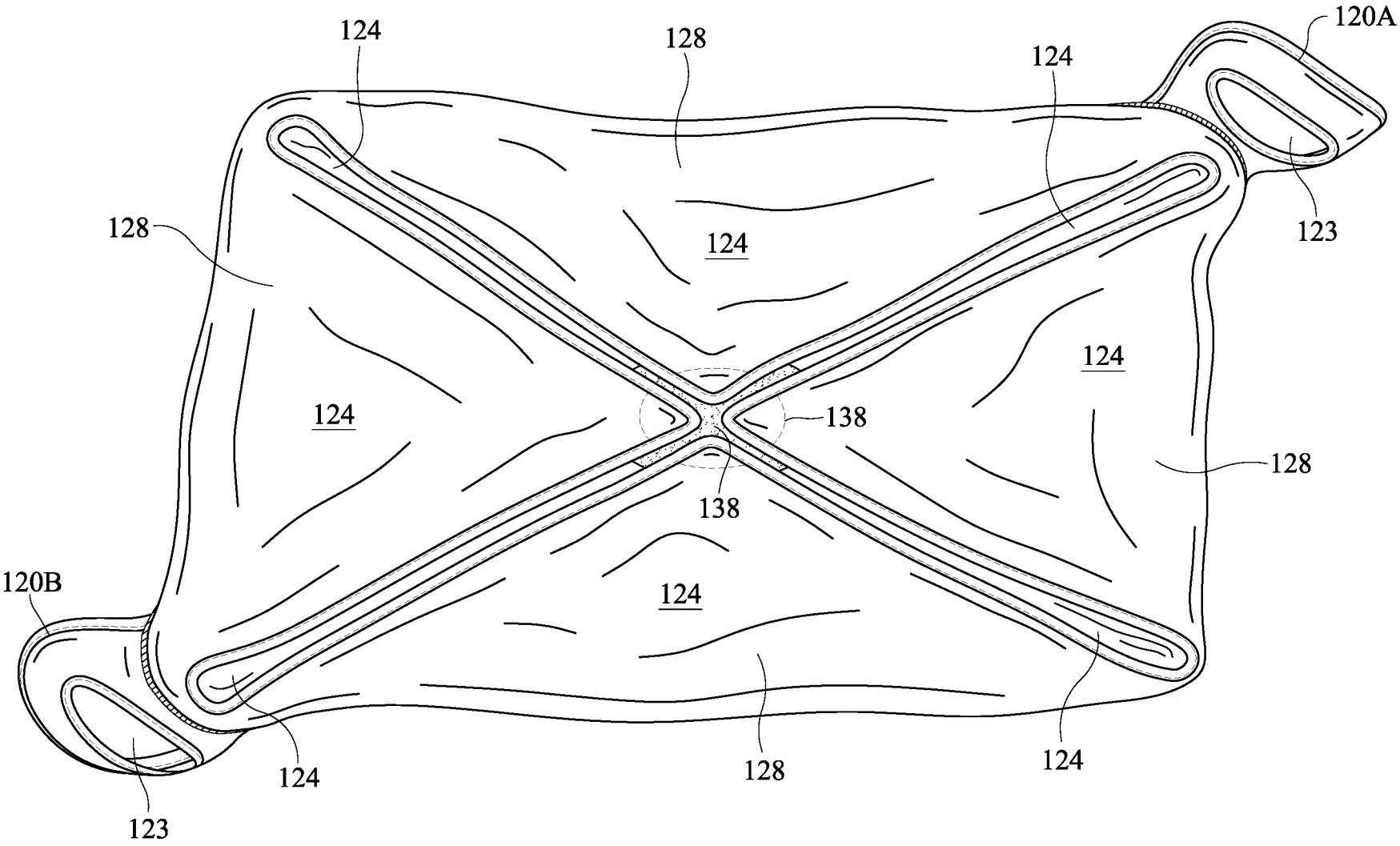
FIG. 16 is top perspective view illustrating the food carrying container of FIG. 11 with the zipper assemblies unfastened to allow the container to be opened and revealing a portion of the protective mat portion folded and secured to itself.
Figure 17:
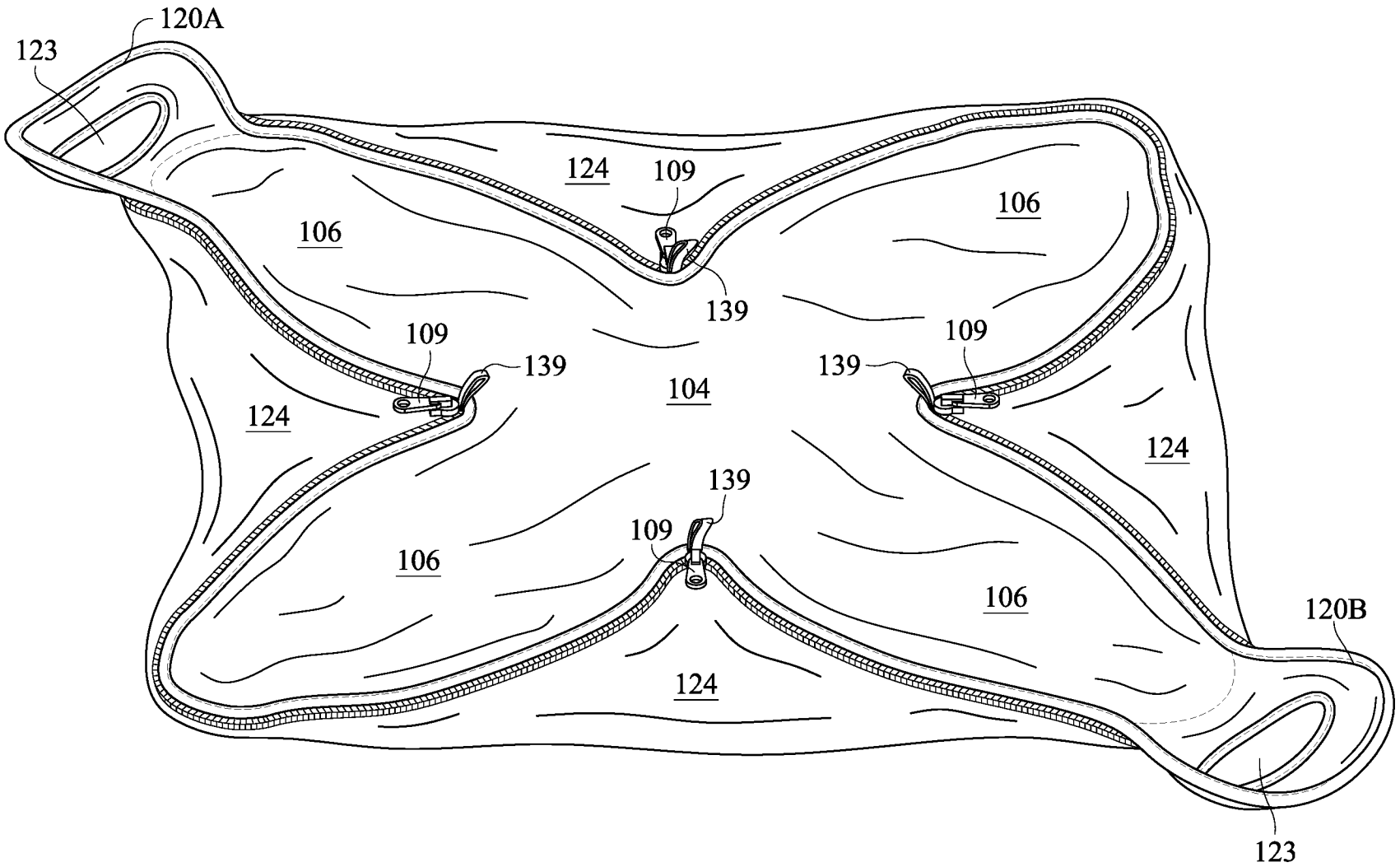
FIG. 17 is a bottom perspective view illustrating the food carrying container of FIG. 11 in the partially converted opened position described for FIG. 16.
Figure 18:
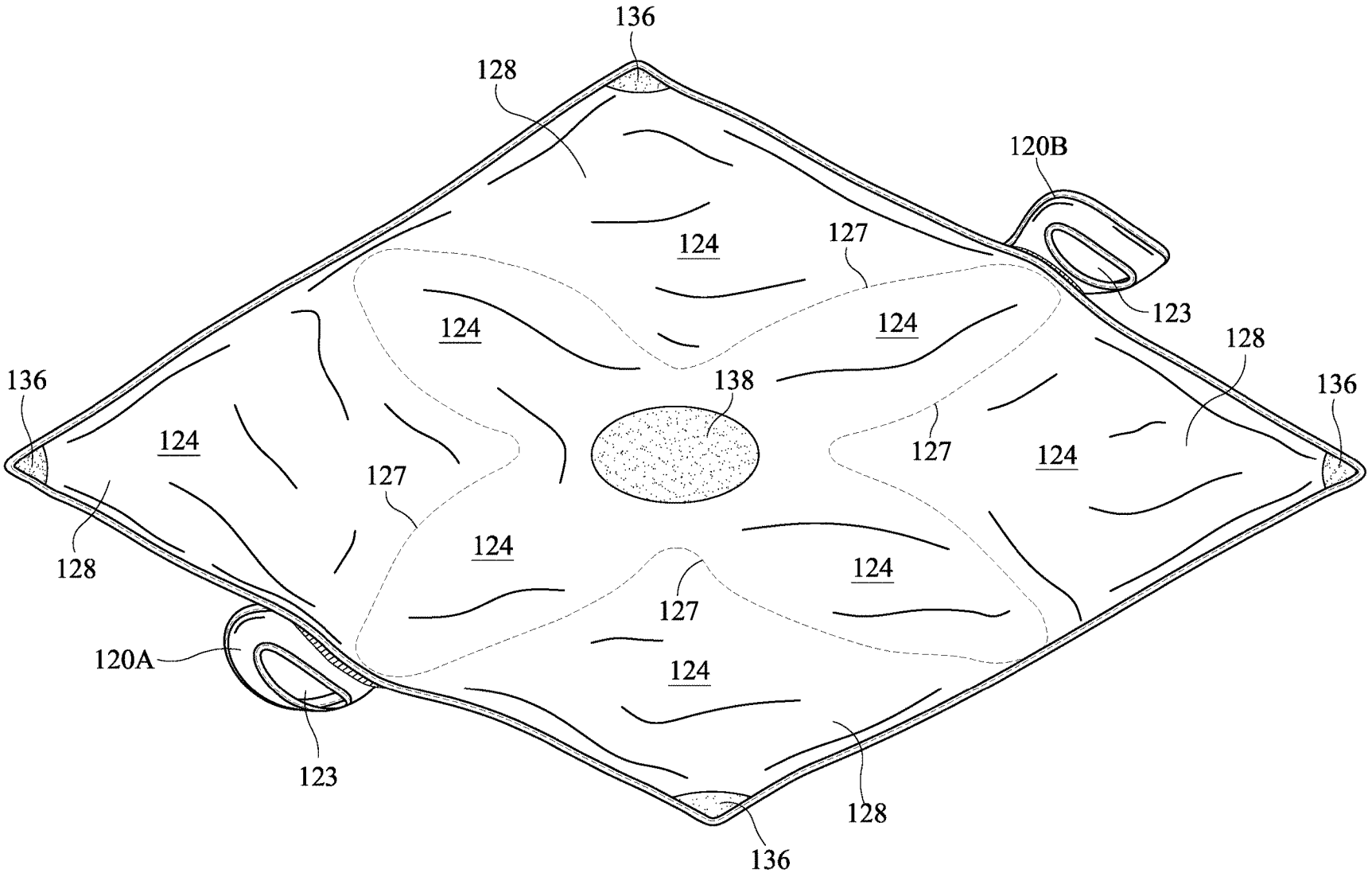
FIG. 18 is a top perspective view illustrating the food carrying container of FIG. 11 in a fully opened position and showing the protective full eating surface for the second embodiment.
Figure 19:
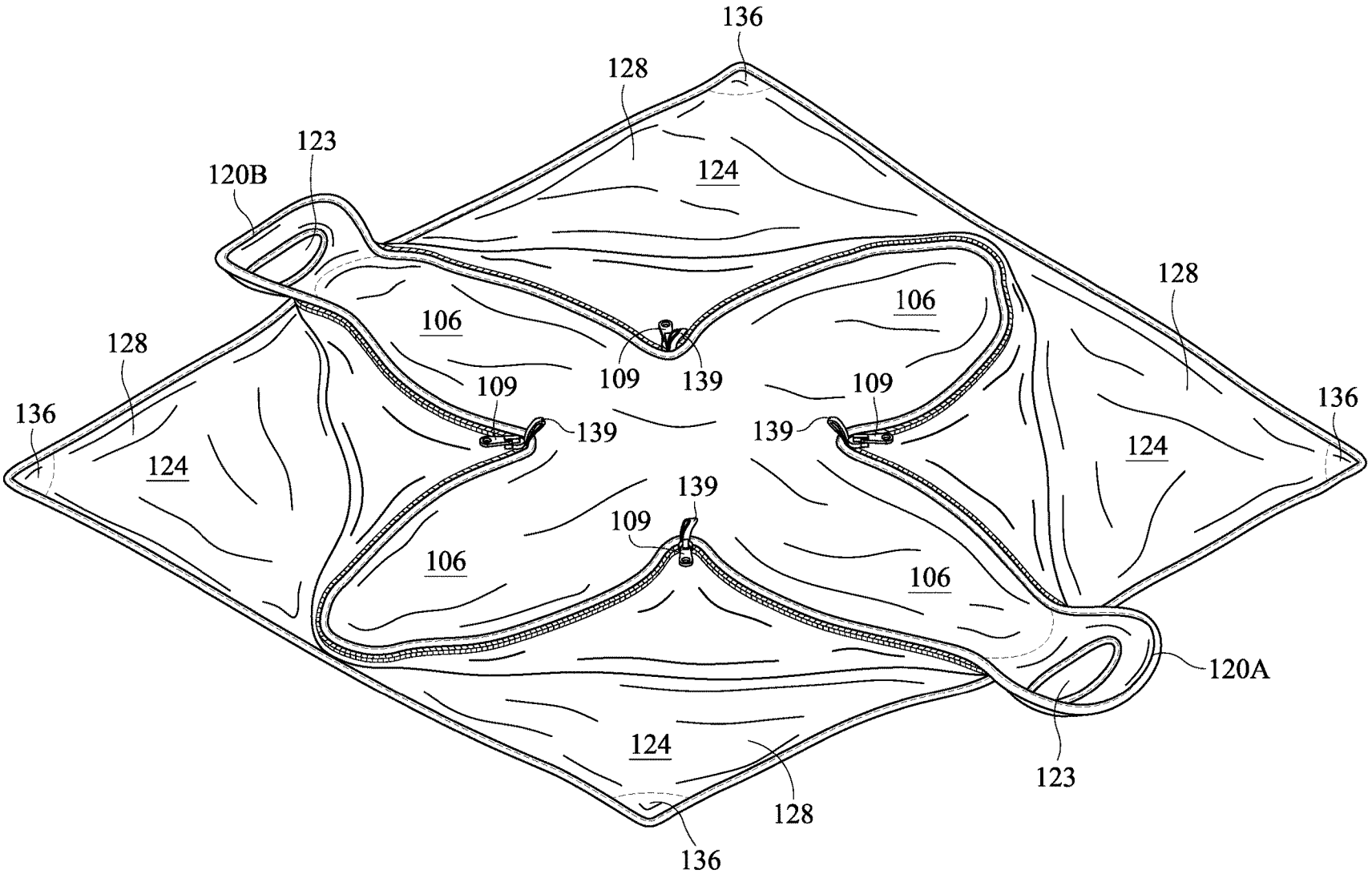
FIG. 19 is a bottom perspective view illustrating the food carrying container of FIG. 11 in the fully opened position.

The washable food carrying container 100 is interchangeable between a closed position and a fully opened position (FIG. 18 and FIG. 19). Prior to the fully opened position, container 100 can be first converted to an unfastened but partially opened (FIG. 16 and FIG. 17). The closed position, wherein fasteners 108 are securing side panels 106 together, represents a container having an interior cavity suitable for storing food items and/or other items. The interior cavity for container 100 is preferably larger in size then the interior cavity of container 10. In a preferred embodiment, side panels 106 and fasteners 108 can be configured such that container 100 is substantially dome or pyramid-shaped when in the closed position. In one embodiment, handle portions 120A and 120B can be included on opposite facing side panels 106 (of two of the side panels) for forming a handle 122 when container 100 is in the closed position. Each handle portion 120A and 120B may include a handle opening 123 sized for receiving a portion of a user's hand. Alternatively, handle 122 and opening 123 may be formed as extensions of opposing side panels 106 (best seen in FIG. 11 and FIG. 13) or can be secured to selected opposing side panels 106 such as, but not limited to, by stitching.

Referring to FIGS. 16-17, the container 100 is shown in an unfastened and partially opened position, wherein the fasteners 108 are undone and the side panels 106 are separated from each other. In the partially opened position, portions of the inner lining member 124 are folded and removable secured to a central portion of the inner lining, such as by mating hook and loop fasteners (136 and 138). Though the central or substantially central position of liner 124 is preferred for the securement location with the edges of the liner 124 other locations on the liner can be used to releasably secure the folded portions 128 of liner 124 in their folded configuration. Though not preferred, in the partially opened configuration shown in FIGS. 16-17, folded liner 124 can be used as a protective mat (i.e. eating surface, etc.), To fully open container 100 and be provided with the maximum eating/protective surface by liner 124, the releasable securement between folded portions 128 and the central area of liner 124 is broken and folded portions are folded to their open position (See FIG. 18). FIG. 19 shows the locations of the separate wall/side panels 106 with respect to fully opened liner 124. FIGS. 16 and 18 show that the side panels 106 are completely covered by liner 124 (in both the partially opened and fully opened liner 124 configurations). Accordingly, side panels 106 form no part of the protective/eating surface which is preferably only provided by liner 124.

The open position represents a preferred protective mat configuration (FIG. 18) for forming a barrier between the surface upon which container 100 is resting and the user. Inner lining 124 serves as the protective mat, such as a placemat, when container 100 is in the open position. Inner lining 124 is attached to the inner facing side of the outer shell 102. When inner lining 124 is secured to outer shell, portions of inner lining 124 form webbing or covering that covers over the space defined between adjacent side panels 106 in the open configuration. Inner lining 124 forms a continuous eating surface by itself. As mentioned above, side panels 106 play no role in forming the continuous eating surface as they are all disposed underneath inner lining 124 in the open position/configuration. Inner lining 124 can be attached to and cover the inner facing side of the outer shell similar to inner lining 24 for container 10, such as, but not limited to, by stitching 127. Other suitable means of attaching inner lining 124 to the outer shell may be used as well and are considered within the scope of the disclosure.

As best seen with respect to FIGS. 16-19, portions 128 of inner lining 124 can be folded and releasably secured to inner lining 124. In one releasable securement embodiment, the outer corner area 130 of each folded portion 128 can be provided with a first securement member and a central area of inner lining 124 can be provided with a second mating securement member. In the preferred embodiment, the first securement member can be a first hook and loop fastener portion 136 and the second securement member can be a second mating hook and loop fastener portion 138. Hook and loop fastener portions 136 and 138 can be secured to inner lining 124 by any conventional means, such as, but not limited to, stitching, sewing, adhesives, tapes, welding, etc. Additionally, other securement mechanisms and/or other locations on inner lining 124 for the securement mechanisms can be used and are considered within the scope of the disclosure. In one non-limiting embodiment, second mating hook and loop fastener 138 can be centrally or substantially centrally located on inner lining 124 and can be circular or substantially circular in shape.

Upon folding portions 128 of inner lining 124 inward, corresponding hook and loop fastener portions 136 and 138 each mate with a portion of centrally located hook and loop fastener portion 134 (FIG. 16). The mating relationship is secure, yet releasable, to allow folded portions 128 to be unfolded to provide a larger usable/eatable surface of inner lining 124 (FIG. 18), as compared to the size of inner lining 24 for container 10. The larger sized eating surface can be achieved through the additions of folded portions 128. Though not preferred, it is also possible to fold portion(s) of inner lining 124 inward to create one or more folded portions 128 that are not releasably secured to inner lining (i.e. no first and second mating fasteners—no hook and loop fasteners) and this unsecured folded inner lining configuration is also within the scope of the disclosure.

The open position, with inner lining 124 providing a continuous eating surface, decreases the likelihood that a user's hands or food items will come into contact with the table surface, thereby reducing the spread of bacteria, viruses and fungi.

In order to store foods items in container 100, it is preferable for container 100 to be partially opened, such that the fasteners 108 are partially separated to allow the upper portions of adjacent side panels 106 to be separated from each other for easy loading of container 100. Alternatively, container 100 can be loaded by configuring one or two side panels 106 in the open position (portions 128 are preferably folded and secured to inner lining 124), by unsecuring their associated fasteners 108 to provide access to internal area of container 100 (similar to FIG. 2 for container 10).

In a preferred embodiment, outer shell 102, inner lining 124 and fasteners 108 can each be made from a machine washable material. In one embodiment, outer shell 102 can preferably be made from a heat resistant material, such as neoprene fabric. Outer shell 102 may be made from one layer of material. Other embodiments of the outer shell 102 can include multiple layers of different materials having varying thicknesses. For example, outer shell 102 can be made from a heat resistant material and inner lining 124 (i.e. continuous eating surface) of container 100 can be made from a washable nylon or neoprene fabric. The different layers of materials may be attached together by conventional methods, such as, but not limited to, one or more of the following: adhesives, sewing, stitching, welding, glues, and tapes.

A tab 139 (preferably a fabric tab) can be disposed at the base of each zipper assembly (i.e. at or near the bottom corner in the closed figuration) 108, which can be grabbed by the user and makes moving the associated zipper up and down easier. In one non-limiting embodiment, tab can be in the form of one or more loops 140, with each loop 140 secured at or near an associated bottom corner when container 100 is in the closed figuration. Additionally, each zipper assembly can be provided with an grab extension (i.e. preferably made from rubber) that is secured to the normal grabbing portion of the zipper to make the grabbing area larger and thus, easier to hold onto when moving the zipper up and down. In one non-limiting embodiment, the grab extension can be substantially rectangularly in shape and can have its outer end somewhat dome shaped, though such is not considered limiting.

Thus, the disclosed embodiments show a carry container that is convertible into a protective mat, and the carry container can comprise in one non-limiting embodiment:

an outer shell including a bottom panel and a plurality of side panels extending from the bottom panel and terminating at an apex, the adjacent panels of the plurality of side panels defining a space therebetween;

an inner lining formed by a generally square sheet attached to an inner facing side of said outer shell so that each corner of the inner lining aligns with the apex of a correspondingly positioned one of the plurality of side panels, the inner lining defining a plurality of web portions, each of the web portions located adjacent to a corresponding space defined by adjacent panels of the plurality of side panels, the inner lining providing a protective mat having a continuous outer flat or substantially flat surface when the outer shell is in an open position with the plurality of side panels and the bottom panel disposed underneath of the inner lining in the open position; and at least one fastener on each of the plurality of side panels structured and disposed for releasably securing each of the plurality of side panels to each neighboring or adjacent side panel so that that outer shell is converted into a closed position, and the bottom panel and plurality of side panels defining an interior cavity or area for enclosing or storing one or more items in the outer shell.

The bottom panel and plurality of side panels can form a substantially dome or pyramid shaped configuration in the closed position. The carry container can further comprise a handle. In one embodiment, the handle comprises a first handle member extending substantially upward from a first of the plurality of side panels in the closed position and a second handle member extending substantially upward from a second of the plurality of side panels in the closed position. The first side panel and the second side panel positioned opposite of each other. The first and second handle members being sized and configured to be adjacently positioned when the outer shell is in the closed position such that a user can grasp both the first and second handle member with one hand.

The fastener can be a zipper fastener, a hook and loop fastener, a magnetic fastener, a clip fastener, etc. The outer shell can be made from a heat resistant material, a neoprene fabric, a nylon, etc. The outer shell, inner lining and at least one fastener can be machine washable.

Though inner lining 24 or 124 is preferably square shaped, other shapes can be used for inner lining, including, without limitation, circular, elliptical, rectangular, etc.

Although the present invention has been shown and described as being suitable for carrying food items, it is not limited to such, and may be used to carry other objects at the discretion of the user.

All measurements, dimensions, amounts, sizes, shapes, percentages, configurations, securement or attachment mechanisms, numbers, ranges, values, percentages, materials, orientations, methods of manufacture, etc. discussed above or shown in the drawing figures are merely by way of example and are not considered limiting and other measurements, dimensions, amounts, sizes, shapes, percentages, configurations, securement or attachment mechanisms, numbers, ranges, values, percentages, materials, orientations, methods of manufacture, etc. can be chosen and used and all are considered within the scope of the invention. Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic (s) or function(s) to be included for the claim element, claim step or claim term in the claim for examination purposes and when and if the claim element, claim step or claim term is interpreted or construed, and such feature(s), part(s), components(s), characteristic(s) or function(s) should not be read into the claim, claim element, claim step or claim term. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to or described with the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

While the present invention has been shown and described in accordance with several preferred and practical embodiments thereof, it is recognized that departures from the instant disclosure are fully contemplated within the spirit and scope of the invention.

What is claimed is:

1. A carry container that is convertible into a protective mat, and said carry container comprising:

a shell including a bottom panel and a plurality of side panels extending from the bottom panel, adjacent panels of said plurality of side panels defining a space therebetween in an open position;

an inner lining formed attached to an inner facing side of said shell, said inner lining defining a plurality of web portions, each of said web portions located adjacent to a corresponding space defined by adjacent panels of said plurality of side panels, said inner lining providing a protective mat having a continuous upper substantially flat surface when said shell is in a fully opened second position with said plurality of side panels and said bottom panel disposed underneath of said inner lining in the open position, wherein in a first shell opened position at least one portion of said inner lining is folded inward such that the protective mat is not fully opened; and at least one fastener on each of said plurality of side panels structured and disposed for releasably securing each of said plurality of side panels to each neighboring side panel so that said shell is converted into a closed position, and the bottom panel and plurality of side panels defining an interior cavity for enclosing an item in said shell;

wherein in a shell fully opened and flat position and prior to attaching the separate lining to the shell adjacent panels of the four side panels each define an unobstructed substantially inverted triangular shaped opening between the two adjacent panels extending from the bottom panel to the outer ends of the adjacent panels.

2. The carry container of claim 1 wherein said bottom panel and plurality of side panels forming a substantially dome or pyramid shaped configuration in the closed position.

3. The carry container of claim 1 further comprising a handle.

4. The carry container of claim 3 wherein said handle comprises a first handle member extending substantially upward from a first of said plurality of side panels in the closed position and a second handle member extending substantially upward from a second of said plurality of side panels in the closed position, said first side panel and said second side panel positioned opposite of each other, said first and second handle members being sized and configured to be adjacently positioned when said shell is in the closed position such that a user can grasp both said first handle member and said second handle member with one hand.

5. The carry container of claim 1 wherein said at least one fastener is a zipper fastener.

6. The carry container of claim 1 further comprising a first fastener member secured to the at least one portion of the inner lining and a second fastener member secured to another portion of the inner lining, wherein in the first shell opened position the one portion of the inner lining is releasably secured to the another portion of the inner lining by the mating of the first fastener member with the second fastener member.

7. The carry container of claim 6 wherein said first fastener member and said second fastener member are hook and loop fastenings members.

8. The carry container of claim 1 wherein said at least one portion of the inner lining are a plurality of portions of the inner lining, each portion having an outer corner and substantially triangular in shape.

9. The carry container of claim 8 further comprising a first fastener member secured at an outer corner of a first of said plurality of portions, a second fastener member secured at an outer corner of a second of said plurality of portions, a third fastener member secured at an outer corner of a third of said plurality of portions and a fourth fastener member secured at an outer corner of a fourth of said plurality of portions.

10. The carry container of claim 9 further comprising a mating fifth fastener member secured at a center or substantially center area of the inner lining; wherein in the first shell opened position said first portion is folded such that the first fastener member is releasably secured to a first area of the fifth fastener member, the second portion is folded such that the second fastener member is releasably secured to a second area of the fifth fastener member, the third portion is folded such that the third fastener member is releasably secured to a third area of the fifth fastener member and the fourth portion is folded such that the fourth fastener member is releasably secured to a fourth area of the fifth fastener member.

11. The carry container of claim 10 wherein said first fastener member, said second fastener member, said third fastener member, said fourth fastener member and said fifth fastener member are hook and loop fasteners.

12. A carry container that is convertible into a protective mat, and said carry container comprising:

a shell including a bottom panel and a plurality of side panels extending from the bottom panel, adjacent panels of said plurality of side panels defining a space therebetween in an open position;

an inner lining attached to an inner facing side of said shell, said inner lining defining a plurality of web portions, each of said web portions located adjacent to a corresponding space defined by adjacent panels of said plurality of side panels, said inner lining providing a protective mat having a continuous upper substantially flat surface when said shell is in a fully opened second position with said plurality of side panels and said bottom panel disposed underneath of said inner lining in the open position, wherein in a first shell opened position a plurality of portions of said inner lining are folded inward such that the protective mat is not fully opened, wherein said plurality of portions include a first portion, a second portion, a third portion and a fourth portion, each of said plurality of portions having an outer corner and substantially triangular in shape; and at least one fastener on each of said plurality of side panels structured and disposed for releasably securing each of said plurality of side panels to each neighboring side panel so that said shell is converted into a closed position, and the bottom panel and plurality of side panels defining an interior cavity for enclosing an item in said shell;

wherein in a shell fully opened and flat position and prior to attaching the separate lining to the shell adjacent panels of the four side panels each define an unobstructed substantially inverted triangular shaped opening between the two adjacent panels extending from the bottom panel to the outer ends of the adjacent panels.

13. The carry container of claim 12 further comprising a first fastener member secured at an outer corner of the first portion, a second fastener member secured at an outer corner of the second portion, a third fastener member secured at an outer corner of the third portion, a fourth fastener member secured at an outer corner of the fourth portion and a fifth fastener member secured at a center or substantially center area of the inner lining; wherein in the first shell opened position said first portion is folded such that the first fastener member is releasably secured to a first area of the fifth fastener member, the second portion is folded such that the second fastener member is releasably secured to a second area of the fifth fastener member, the third portion is folded such that the third fastener member is releasably secured to a third area of the fifth fastener member and the fourth portion is folded such that the fourth fastener member is releasably secured to a fourth area of the fifth fastener member.

14. The carry container of claim 13 wherein said first fastener member, said second fastener member, said third fastener member, said fourth fastener member and said fifth fastener member are hook and loop fasteners.

15. The carry container of claim 12 wherein said bottom panel and plurality of side panels forming a substantially dome or pyramid shaped configuration in the closed position.

16. The carry container of claim 12 further comprising a handle.

17. The carry container of claim 16 wherein said handle comprises a first handle member extending substantially upward from a first of said plurality of side panels in the closed position and a second handle member extending substantially upward from a second of said plurality of side panels in the closed position, said first side panel and said second side panel positioned opposite of each other, said first and second handle members being sized and configured to be adjacently positioned when said shell is in the closed position such that a user can grasp both said first handle member and said second handle member with one hand.

18. The carry container of claim 12 wherein said at least one fastener is a zipper fastener.

19. A carry container that is convertible into a protective mat, and said carry container comprising:

a shell including a bottom panel and a plurality of side panels extending from the bottom panel, adjacent panels of said plurality of side panels defining a space therebetween in an open position;

an inner lining formed attached to an inner facing side of said shell, said inner lining defining a plurality of web portions, each of said web portions located adjacent to a corresponding space defined by adjacent panels of said plurality of side panels, said inner lining providing a protective mat having a continuous upper substantially flat surface when said shell is in a fully opened second position with said plurality of side panels and said bottom panel disposed underneath of said inner lining in the open position, wherein in a first shell opened position a plurality of portions of said inner lining are folded inward such that the protective mat is not fully opened, wherein said plurality of portions include a first portion, a second portion, a third portion and a fourth portion, each of said plurality of portions having an outer corner and substantially triangular in shape;

a first hook and loop fastener secured at an outer corner of the first portion;

a second hook and loop fastener secured at an outer corner of the second portion;

a third hook and loop fastener secured at an outer corner of the third portion;

a fourth hook and loop fastener secured at an outer corner of the fourth portion;

a fifth hook and loop member secured at a center or substantially center area of the inner lining; and at least one panel fastener on each of said plurality of side panels structured and disposed for releasably securing each of said plurality of side panels to each neighboring side panel so that said shell is converted into a closed position, and the bottom panel and plurality of side panels defining an interior cavity for enclosing an item in said shell;

wherein in the first shell opened position said first portion is folded such that the first hook and loop fastener is releasably secured to a first area of the fifth hook and loop fastener, the second portion is folded such that the second hook and loop fastener is releasably secured to a second area of the fifth hook and loop fastener, the third portion is folded such that the third hook and loop fastener is releasably secured to a third area of the fifth hook and loop fastener and the fourth portion is folded such that the fourth hook and loop fastener member is releasably secured to a fourth area of the fifth hook and loop fastener;

wherein said bottom panel and plurality of side panels forming a substantially dome or pyramid shaped configuration in the closed position;

wherein in a shell fully opened and flat position and prior to attaching the separate lining to the shell adjacent panels of the four side panels each define an unobstructed substantially inverted triangular shaped opening between the two adjacent panels extending from the bottom panel to the outer ends of the adjacent panels.

20. The carry container of claim 19 further comprising a plurality of tabs, each tab from said plurality of tabs disposed at a bottom corner of the outer shell when in a closed configuration and available to a user to hold on to with one hand while moving an associated zipper assembly with an other hand of the user.

* * * * *